US009522567B2

(12) United States Patent
Braun et al.

(10) Patent No.: US 9,522,567 B2
(45) Date of Patent: Dec. 20, 2016

(54) METHOD FOR THE REFINEMENT OF A PANEL AND APPARATUS FOR CARRYING OUT THE SAME

(75) Inventors: Roger Braun, Willisau (CH); Norbert Kalwa, Meinberg (DE)

(73) Assignee: FLOORING TECHNOLOGIES LTD., Pieta (MT)

( * ) Notice: Subject to any disclaimer, the term of this patent is extended or adjusted under 35 U.S.C. 154(b) by 875 days.

(21) Appl. No.: 13/163,077

(22) Filed: Jun. 17, 2011

(65) Prior Publication Data

US 2012/0027957 A1 Feb. 2, 2012

(30) Foreign Application Priority Data

Jun. 30, 2010 (EP) ..... 10006777

(51) Int. Cl.

| | |
|---|---|
| ***B44C 5/04*** | (2006.01) |
| ***B41M 5/00*** | (2006.01) |
| ***E04F 15/02*** | (2006.01) |
| ***B44C 1/17*** | (2006.01) |

(52) U.S. Cl.

CPC ..... *B44C 5/0476* (2013.01); *B41M 5/0041* (2013.01); *B44C 1/1712* (2013.01); *B44C 5/043* (2013.01); *E04F 15/02* (2013.01)

(58) Field of Classification Search

CPC ..... B65D 71/08; B65D 2571/00012
See application file for complete search history.

(56) References Cited

U.S. PATENT DOCUMENTS

| | | | | |
|---|---|---|---|---|
| 3,809,223 | A * | 5/1974 | Kendall | B65D 71/08 206/204 |
| 4,354,851 | A | 10/1982 | Hix et al. | |
| 4,880,678 | A * | 11/1989 | Goffi | 428/32.81 |
| 5,506,031 | A | 4/1996 | Spain et al. | |
| 7,660,750 | B1 | 2/2010 | Goodson et al. | |

(Continued)

FOREIGN PATENT DOCUMENTS

| | | |
|---|---|---|
| DE | 102004033237 | 7/2004 |
| EP | 1454763 | 8/2009 |

(Continued)

OTHER PUBLICATIONS

SVF(Selecting Vinyl Flooring—Utah State University Extension, Posted online on Feb. 1, 2002.*

(Continued)

*Primary Examiner* — Francisco Tschen
(74) *Attorney, Agent, or Firm* — Andrew M. Calderon; Roberts Mlotkowski Safran Cole & Calderon, P.C.

(57) ABSTRACT

A method for the refinement of a panel and an apparatus for the refinement of a panel according to a method of this type. The method for the refinement of a panel includes: unpacking of a panel having a core made from wood material from a transport-safe packaging, a grounding in the form of at least one synthetic resin layer pressed together with the core and, if appropriate, a primer being arranged on a top side of the core, and a coating being arranged on a core underside lying opposite the top side of the core, and connection and locking means being attached to at least two mutually opposite side faces; application of a decorative layer having a decoration to the grounding or primer; and application of at least one wear layer to the decorative layer.

37 Claims, 3 Drawing Sheets

(56) References Cited

U.S. PATENT DOCUMENTS

| | | | | |
|---|---|---|---|---|
| 2001/0001218 | A1* | 5/2001 | Luongo | B28B 11/24 264/42 |
| 2002/0132050 | A1* | 9/2002 | Frame | 427/274 |
| 2004/0045240 | A1* | 3/2004 | McIlvaine | 52/311.2 |
| 2004/0086676 | A1* | 5/2004 | Peng | 428/40.1 |
| 2008/0070015 | A1 | 3/2008 | Fischer | |
| 2009/0126600 | A1* | 5/2009 | Zupancich et al. | 105/404 |
| 2009/0250158 | A1* | 10/2009 | Streb | B32B 38/10 156/219 |
| 2009/0252925 | A1* | 10/2009 | Provoost et al. | 428/151 |
| 2010/0023165 | A1 | 1/2010 | Snyder | |

FOREIGN PATENT DOCUMENTS

| | | | |
|---|---|---|---|
| EP | 2202056 | A1 * | 6/2010 |
| JP | 2002019390 | | 1/2002 |
| WO | WO2006091831 | | 8/2006 |
| WO | WO2010055429 | | 5/2010 |

OTHER PUBLICATIONS

Frequently Asked Questions, Holo-Floor 2 Decorative Floor Film, Holo Walls LLC, Retrieved from Wayback Machine for date Sep. 28, 2010, https://web.archive.org/web/20100928215414/http://www.holowalls.com/pdf/holofloor2-4.pdf.*

Wausau Awards and Engraving Website, https://web.archive.org/web/20090503130034/http://www.wausauawards.com/color-photo-tile-mural-creation-process.htm, Retrieved on May 4, 2014, Captured by the WayBackMachine on May 3, 2009, pp. 1-6.*

Mital et al. Product Development, A Structure Approach to Consumber Product Development, Design and Manufacture, 2008, Elsevier, pp. 403-405.*

Merrian Webster Definitions for "production", "plant" retrieved online on Mar. 19, 2016 at http://www.merriam-webster.com/, p. 1.*

* cited by examiner

METHOD FOR THE REFINEMENT OF A PANEL AND APPARATUS FOR CARRYING OUT THE SAME

CROSS REFERENCE TO RELATED APPLICATIONS

The present application claims priority under 35 U.S.C. §119 of Patent Application No. EP 10006777.6, filed on Jun. 30, 2010, and which is expressly incorporated by reference herein in its entirety.

FIELD OF THE INVENTION

The invention relates to a method for the refinement of a panel and to an apparatus for the refinement of a panel according to a method of this type.

DISCUSSION OF BACKGROUND INFORMATION

Laminate panels have already been known for some time in the prior art, and nowadays many different applications, particularly as a replacement for genuine wood panels, can no longer be imagined without them. An especially major field of use is the cladding of walls, ceilings and floors, where the respective cladding is assembled from corresponding wall, ceiling and floor panels. Of course, in different fields of use, the surface quality of laminate panels of this type must satisfy different requirements. A floor panel is of course in this case exposed to substantially higher loads than, for example a wall or ceiling cladding.

The large-scale manufacture of laminate panels in this case involves a whole series of manufacturing steps which are largely identical for the various types of panel. First, a carrier board made, for example, from a wood material, such as MDF, HDF or OSB, is provided, and this is coated with a plurality of layers of, if appropriate, different materials. A decorative layer is supplied to an, if appropriate, pre-treated surface of a wood material board which has been provided as the core of the panel to be produced. This may take place, for example, in the form of a printed impregnated paper. The paper may also be printed directly onto the topside of the wood material board. This may take place by means of pressure rollers or a digital printer. Before the decoration is printed on, if appropriate, a grounding layer may also be applied to the surface of the wood material board. This decoration, particularly in so far as the panel is to be used as a floor panel, has to be covered by at least one wear layer. This may consist, for example, of a lacquer or of a synthetic resin. Advantageously, abrasion-resistant particles (for example, corundum) are admixed and make the surface of the finished panel more resistant to load caused by walking on it. The layer build-up with, if appropriate, a plurality of synthetic resin layers is finally pressed in a press under the influence of pressure and temperature, as disclosed in EP 1 454 763 B1 to which reference is made in full. Subsequently, the still large-format, now coated wood material board is divided into individual panels. After division into individual panels, connection means in the form of a tongue and groove with integrated locking means are attached to the side faces, so that two panels can be connected to one another by means of what is known as a "snap connection" and can be interlocked in the vertical and horizontal direction. In order to increase the realistic appearance of a laminate panel, it is known, during the pressing of the layer build-up, to emboss into the topside a structure matching with the decoration (embossed-in-register). The laminate panel is thereby further equated, for example, to a genuine wood panel not only visually, but also by feel.

Alternatively, coating may also take place with lacquer layers which are subsequently cured, using high-energy radiation, for example electron and UV radiation. In this case, too, the large-format coated carrier board is divided into panels only after the complete curing of the layers applied.

In the market of laminate panels, in particular of floor panels, a demand for ever more diverse decoration variants has been seen. Thus, there is a demand not only for ever new wood imitations, but also, increasingly, for tile and brick decorations and also fantasy decorations in the most diverse possible forms. However, the conversion of a large-scale manufacturing plant for laminate panels to a new decoration is relatively complicated and time-intensive and is therefore costly. Moreover, for example when the decoration is applied in the form of a printed decorative paper to the wood material core, decorative papers having diverse decorations have to be kept in stock. This requires a large amount of storage space and also ties up an unnecessarily large amount of capital due to the large quantity of decorative papers to be kept in reserve.

If the decoration is printed directly onto the wood material board, for example, via pressure rollers, a dedicated set of rollers has to be kept in reserve for each decoration, particularly the procurement of these rollers being cost-intensive. When a structure is to be embossed into the topside, the press platens or press plates additionally have to be engraved cost-intensively. Moreover, the exchange of such press platens or press plates takes up time during which the production plant is at a standstill, and therefore the production costs for laminate panels rise.

For the abovementioned reasons, it is economically expedient to produce relatively large quantities of laminate panels with a decoration once selected before panels having another decoration are produced.

However, as well as the demand for ever more diverse decoration variants, a growing reduction in the order sizes demanded is also to be seen. If, however, quantities of laminate panels with a specific decoration which are too small are demanded, these cannot be produced economically. Individual orders therefore have to be "collected" by the trade or by wholesalers, thus resulting for the end user in long delivery times which are unacceptable particularly in the do-it-yourself sector. Some of the demand consequently cannot be satisfied.

WO 2010/055429 A2 discloses a method for the production of a panel, in which, first, a grounding is applied to the topside of a large-format wood material board. The wood material board thus grounded is, if appropriate, pressed and is subsequently divided into individual panels. Only thereafter are the individual panels printed with the desired decoration.

One disadvantage is that, although, by virtue of the method described in the publication mentioned, the manufacturing plant itself can be designed to be smaller and more compact since the large-format wood material boards no longer have to be printed, but, instead, smaller panels, it is usually not possible to achieve faster delivery times for small batch sizes with individual decorations. If a customer orders a small quantity of panels having a desired decoration, for example, from a panel dealer, the dealer will collect the incoming orders until he orders, overall, a sufficient number of panels from the panel manufacturer. This is necessary in order to keep the transport costs within justifiable limits, since laminate panels are transported, for example, by large heavy goods vehicles which, so that they can operate efficiently, have to be loaded up to a certain capacity. Although the efficiency of the production method can be increased, using smaller plants, by virtue of the method described in WO 2010/055429 A2, flexibility, particularly regarding the fast delivery of small and very small batch sizes with individual decorations, is not achieved.

SUMMARY OF THE INVENTION

The problem to be solved according to the invention is, therefore, that, with the current procedure for producing the laminate panels required by the end user, it is not possible for economic reasons to satisfy even unusual customer wishes in a justifiable delivery time, in so far as a minimum batch size is not required, and that, even if the minimum batch size were to be reached (for example, in the article sector, that is to say the equipment of large offices or hotels), a longer delivery time has to be taken into account, because, of course, the plant at the panel manufacturer's first has to be converted accordingly, this not being possible within a few hours or days even in the worst order situation.

This problem can be solved in that the chain of the production process is interrupted and the dealer who receives the end user's wish for a decoration can apply the decoration himself to the panels. However, the dealer cannot handle and divide up wood material boards having dimensions of several meters.

The object on which the invention is based is, therefore, to propose a method which affords the possibility that a dealer to whom raw panels are made available can subsequently provide these with a decoration according to the customer's wish, so that even very small order sizes can be produced flexibly and efficiently and at the same time the storage and material costs are reduced.

The invention achieves the set object by means of a method for the refinement of a panel, with the following steps:

a) unpacking of a panel having a core made from wood material from a transport-safe packaging, a grounding in the form of at least one synthetic resin layer pressed together with the core and, if appropriate, a primer being arranged on a top side of the core, and a coating being arranged on a core underside lying opposite the top side of the core, and connection and locking means being attached to mutually opposite side faces,
b) application of a decorative layer having a decoration to the grounding or the primer,
c) application of at least one wear layer to the decorative layer.

The decorative layer is in this case advantageously printed directly onto the grounding or primer. Alternatively, a decorative paper may also be printed with a decoration and laid as a decorative layer onto the grounding or primer. The at least one wear layer advantageously consists of a synthetic resin and, after being applied, is cured by pressing under the influence of pressure and temperature. In this case, in particular, a structure may be introduced into the at least one wear layer.

Alternatively, the at least one wear layer may also consist of a lacquer which, after being applied, is cured by means of electron or UV beams. By a structure-forming lacquer being printed on, a structure can in this case be introduced into the at least one wear layer. Alternatively, means disturbing the flow of the lacquer may also be printed on, structure-forming depressions and/or elevations thereby being generated.

It has proved especially advantageous if the application of the decorative layer and of the at least one wear layer takes place by means of the following steps:

provision of the at least one wear layer on a carrier medium,
printing of the decorative layer onto the at least one wear layer,
laying of the layer build-up consisting of the carrier medium, of the at least one wear layer and decorative layer onto the grounding or primer, so that the decorative layer is arranged on the grounding or primer, and
removal of the carrier medium.

A structure may subsequently be embossed into the at least one wear layer. The structure introduced into the at least one wear layer in this case advantageously matches the decoration of the decorative layer in order to improve the natural appearance of the imitated material. Before the decorative layer is applied, the panel is advantageously cleaned.

An apparatus according to the invention for the refinement of a panel according to a method described above comprises, in particular, a printing unit for printing a decoration onto the grounding or primer, the decorative paper or the carrier medium coated with the at least one wear layer, an input device for inputting a choice of a decoration stored in the form of electronic data in a data store from a plurality of available decorations by a user, and an electrical control which is set up for reading the chosen decoration out of the data store and for activating the printing unit such that the chosen decoration is printed. The apparatus advantageously has an indicator device, via which the available decorations are indicated to the user.

The idea on which the invention is based is to make the production of laminate panels, particularly for use as wall, ceiling and floor coverings, more flexible, simpler and more cost-effective. For this purpose, there is provision, within the framework of large-scale manufacture, for producing only grounded panels as semi-finished products. These have a core made from wood material which may be designed, for example, as OSB, MDF or HDF. This is coated with a grounding which is pressed together with the core of the wood material board. This gives rise to an easily printable surface which has the required properties for ensuring an excellent printed image during subsequent printing. The grounding in the form of a synthetic resin layer may in this case be applied in the most diverse possible forms to the core made from wood material. It is conceivable, for example, for application to be in the form of a resin-impregnated paper, as a synthetic resin layer applied directly to the topside or in the form of a finish film which is pasted on, for example, by means of an adhesive which may contain synthetic resin. All these applied groundings lead to an especially high surface quality. Depending on the grounding applied to the wood material board, a coating is applied to the underside lying opposite the topside of the wood material board. This coating may, for example, assume the function of counteraction. This is necessary particularly when, during the drying of the applied grounding, a tensile force is exerted upon the wood material board parallel to the surface of the latter.

By corresponding coating being applied to the underside of the wood material board, a corresponding force is also exerted upon the underside, so that arching or dishing of the wood material board is effectively prevented.

If the grounding is applied, for example, in the form of a coated film which is already finish-cured, the application of counteraction may be unnecessary. The coating applied to the underside can then, for example, prevent the uptake of moisture into the underside of the wood material board or merely have visual reasons. Thus, the acceptance of a panel on the market by the end consumer can thereby be increased, in particular, in that the wood material board functioning as a core can no longer be seen even on the panel underside which is no longer visible in the installed state.

After the grounding has been applied to the topside and the coating to the underside of the wood material board, the layer build-up is pressed together. This may take place under the influence of pressure and temperature. This is necessary especially when at least one of the applied layers is to be connected to the wood material core. If the grounding is pasted on in the form of an already finish-cured film, pressing under pressure is sufficient.

After the pressing of the layer build-up, the still large-format coated and pressed wood material board is divided into individual panels. Side faces of the panels are subsequently machined by cutting in order to incorporate connection and locking means. These connection and locking means may consist of simple tongue-and-groove profilings or comprise complicated profiles, which ensure that two connected panels are interlocked, for example, both in a vertical and in a horizontal direction. Moreover, connection and locking means may also be incorporated in side edges of panels, into which still separate connection elements which may consist, for example, of plastic are inserted. However, for installing or connecting two identical panels, it is advantageous if connection and locking means are worked, for example milled, out of the panel such that two identical panels can be connected to one another and interlocked without additional connection elements.

The grounded panels thus produced are finally packaged in a transport-safe manner. A quality check may be carried out beforehand in order to ensure that the grounded panels have as high a quality as possible.

Since the laminate manufacturer produces only grounded panels to which the decorative layer does not have to be applied, both the stockkeeping and the material costs for the laminate manufacturer are reduced. Decorative papers having various decorations do not have to be kept in stock or embossing rollers or embossing plates do not have to be provided so that panels having different decorations can be produced. As a result, both the required storage space and the tied-up capital are markedly reduced. Moreover, conversion times are avoided, since all the panels have the same grounding. The production plant can thereby operate more efficiently and the production costs are further reduced.

In order to ensure that the panels thus produced have especially good printability, the grounding is, in particular, coloured. In this case, in particular, a plurality of colours are possible, white or beige are mentioned as examples. In this case, for example, coloured papers are used as the print base, the colour of which corresponds to the lightest colour shade in the decoration to be printed on. If, as here, the decoration to be applied is not yet known, a white or at least very light grounding is therefore advantageous. However, every other colour may likewise be envisaged as a grounding. In order to achieve special effects during the subsequent printing of panels pre-grounded in this way, a structure may be introduced into the grounding. This takes place advantageously during the pressing of the layer build-up, in particular by embossing plates or embossing rollers used in this case.

However, pre-grounded panels produced in this way have, overall, a very smooth surface. In particular, the surface is homogeneous and, in so far as the grounding is coloured, affords good covering. This, in combination with very low fault frequency due to surface faults or dirt particles, is very important particularly for digital printing in which the pre-grounded panel is printed directly by means of a digital printer. A coloured wood material board may at least partially assume the function of a grounding.

Owing to the very low surface roughness of the topside of the panel, which, for example, is less than 20 μm, especially preferably even less than 10 μm, a very good printed image is achieved during subsequent printing. ISO 4287-1 is mainly used as a test standard for the surface roughness. If the wood material board or the grounding is coloured, advantageously, for the colour, a brightness parameter L is higher than 92, a red-green value A lies between −5 and +5, preferably between −2 and +2, and a yellow-blue value B lies between −15 and +15, preferably between −8 and +8. The specified values describe colours in the CIELAB colour range. DIN 6174 is the standard basis for this colour range. The colour of the grounding or of the coloured wood material board should in this case correspond to the lightest colour shade in the decoration to be applied. In so far as the latter is not yet known, as in the present case, it is of course appropriate to have an especially light, particularly white, surface colour.

Panels pre-grounded in this way are stored at the laminate manufacturer's in a central store, for example a high-bay warehouse. They may previously be cleaned and packaged, in particular, such that, in further processing, they can be directly printed or processed, without the panels having to be cleaned again there. However, this must be reserved for only a single type of panel, so that space-intensive storage of panels having different decorations, different surface structures or different surface qualities is no longer necessary.

The grounded panels are subsequently transported for further processing. This may, for example, involve a franchise operation associated with the laminate manufacturer, home-improvement market, an interior decorator, a dealer or a floor layer.

Here, the pre-grounded panels are unpacked from the transport-safe packaging. A decorative layer having a decoration according to the direct customer's wish is subsequently applied to the grounding or primer and covered by at least one wear layer.

The application of the decorative layer to the grounding or to the primer may take place in various ways.

The decorative layer may, in particular, be printed directly onto the grounding or primer. In this case, the pre-grounded panel passes through a printing unit which is advantageously a digital printer. It is thereby possible, in particular, to print different decorations onto different panels quickly and simply in succession, without the printing unit having to be converted to the new decoration. Since only individual panels have to be printed, not entire large-format wood material boards, as is customary in the prior art, the printing unit can be designed to be small and compact and therefore space-saving and cost-effective. Alternatively, a decorative paper, which can be kept in the form of large rollers, may also be printed with a decoration and subsequently be pasted as a decorative layer onto the grounding or primer.

In both the instances, the decorative layer should be covered by at least one wear layer. The number and type of wear layers applied depend in this case greatly on the planned place of use of the panels thus decorated. Particularly in the case of wall and ceiling panels, it is often sufficient when at least one wear layer covers the decorative layer in a wipe-resistant manner. If, however, the printed panels are used as a floor panel, they are exposed to markedly higher load. In this case, in particular, a plurality of wear layers may be applied, to which are admixed additives which increase the abrasion and/or scratch resistance of the topside of the then finished panels.

The at least one wear layer may in this case consist of a synthetic resin and, after being applied, may be cured under the influence of pressure and temperature. During pressing, a structure, which, in particular, matches the decoration of the decorative layer, may also be embossed into the at least one wear layer, in order thereby, for example, to make the natural appearance of a genuine wood decoration closer to reality.

Alternatively, the at least one wear layer may also be in the form of at least one lacquer layer which is then cured, using high-energy radiation, for example electron or UV radiation. In this case, a structure-forming lacquer may also be applied, via which, during curing, a structure can be introduced into the at least one wear layer.

In curing by high-energy radiation and by pressing, in particular, a walk-on surface of the panel can be ensured. This takes place especially when the panel is to be used as a floor panel.

In all the instances mentioned hitherto, in further processing, for example in the home-improvement market, the decorative layer must be covered with at least one layer consisting of a synthetic resin or lacquer and subsequently be cured. For this purpose, a relatively high outlay in terms of apparatus is required, which entails not only an increased amount of space, but also relatively high investment costs. Moreover, it may be necessary to employ specialized personnel in order to operate an apparatus for carrying out the method steps necessary during further processing, in particular during coating with synthetic resin or lacquer.

In an especially simple way, therefore, the decorative layer and the at least one wear layer can be applied to the pre-grounded panel by means of the following method steps. The at least one wear layer is provided on a carrier medium, for example a film. Should a plurality of wear layers be necessary, these are located in reverse order on the carrier medium. The wear layer which is to form the topside in the finished panel is consequently located directly on the carrier medium and is covered by the wear layers which lie under it in the finished panel. During further processing, various layer build-ups of the said at least one wear layer on the carrier medium are kept in stock. The wear layer which is to cover the decorative layer in the finished panel is therefore located at the very top on the carrier medium in the layer build-up. This wear layer is then printed with the decoration to be applied to the panel. The entire layer build-up is subsequently laid onto the grounding or primer such that the decoration then lies directly on the grounding or primer and is covered by the at least one wear layer. The carrier medium, for example the carrier film, is then located at the very top in the layer build-up. This layer build-up is then pressed together with the pre-grounded panel. For this purpose, it is sufficient if pressure is exerted upon the layer build-up. Since the at least one wear layer which is located on the carrier medium is already finish-cured, action under the influence of increased temperature is unnecessary.

Subsequently, the carrier medium is pulled off, and the decorative layer and the at least one wear layer remain on the grounding or primer. It is thus possible to finish-refine the grounded panel, without supplying liquid resins and lacquers which still have to be cured. Both the outlay in terms of apparatus and the investment volume and thereby markedly reduced. In this embodiment, a structure, which matches, in particular, with the decoration of the decorative layer, may also be embossed into the at least one wear layer during the pressing of the layer build-up.

An apparatus for refining a panel according to a method just described comprises in this case, in particular, a printing unit for printing the decoration onto the grounding or primer, the decorative paper or the carrier medium coated with the at least one wear layer, basically in any desired colour and grain, and, moreover, an input device, by means of which a selection of a decoration can be input, which is filed in a data store in the form of electronic data. The apparatus comprises, moreover, an electrical control which is set up for reading the selected decoration out of the data store and for activating the printing unit such that the selected decoration is printed. Also, especially conveniently for the customer, this apparatus comprises an indicator device, via which the available decorations are indicated to the user.

In concrete terms, a method of this type may, for example, in a home-improvement market, proceed as follows.

A customer who requires panels for a specific room size first obtains information as to the number of panels which he needs. He can look at various decorations available for selection on an indicator device of an apparatus by means of which the grounded panel can be refined, as described above. These decorations are filed in the form of electronic data in a data store inside the apparatus. Alternatively, the apparatus could, for example, also have a drive, for example for a CD, DVD or the like. The customer can then also himself bring along a corresponding data carrier on which decorations are stored in a predetermined data format. It is thus possible that the customer receives his completely individual decoration printed on panels.

After the customer has selected a decoration, he inputs this selection via the input device. The customer can also select how many panels are to be printed with the selected decoration and for which purpose he wishes to use these panels. Different wear layers are applied to the panel, depending on the intended use which has been input.

Inside the apparatus, then, the desired decoration is applied to a pre-grounded profiled panel and is covered with the combination of wear layers which is considered necessary. After these are cured, if necessary, the customer can receive the panels printed with his individual decoration and can use them.

Should he notice in this case that he has not had sufficient panels printed or that it would be necessary, for example, to exchange individual panels which have become worn in the course of time, it is possible at any time for him to reorder individual panels on an apparatus described.

As a result, flexibility in the production of laminate panels is markedly increased, and even the smallest application quantities having the most diverse possible decorations can expediently be produced efficiently.

BRIEF DESCRIPTION OF THE DRAWINGS

The method described is explained in more detail below with the aid of the following illustrative drawings in which.

DETAILED DESCRIPTION OF THE PRESENT INVENTION

Figure 1:
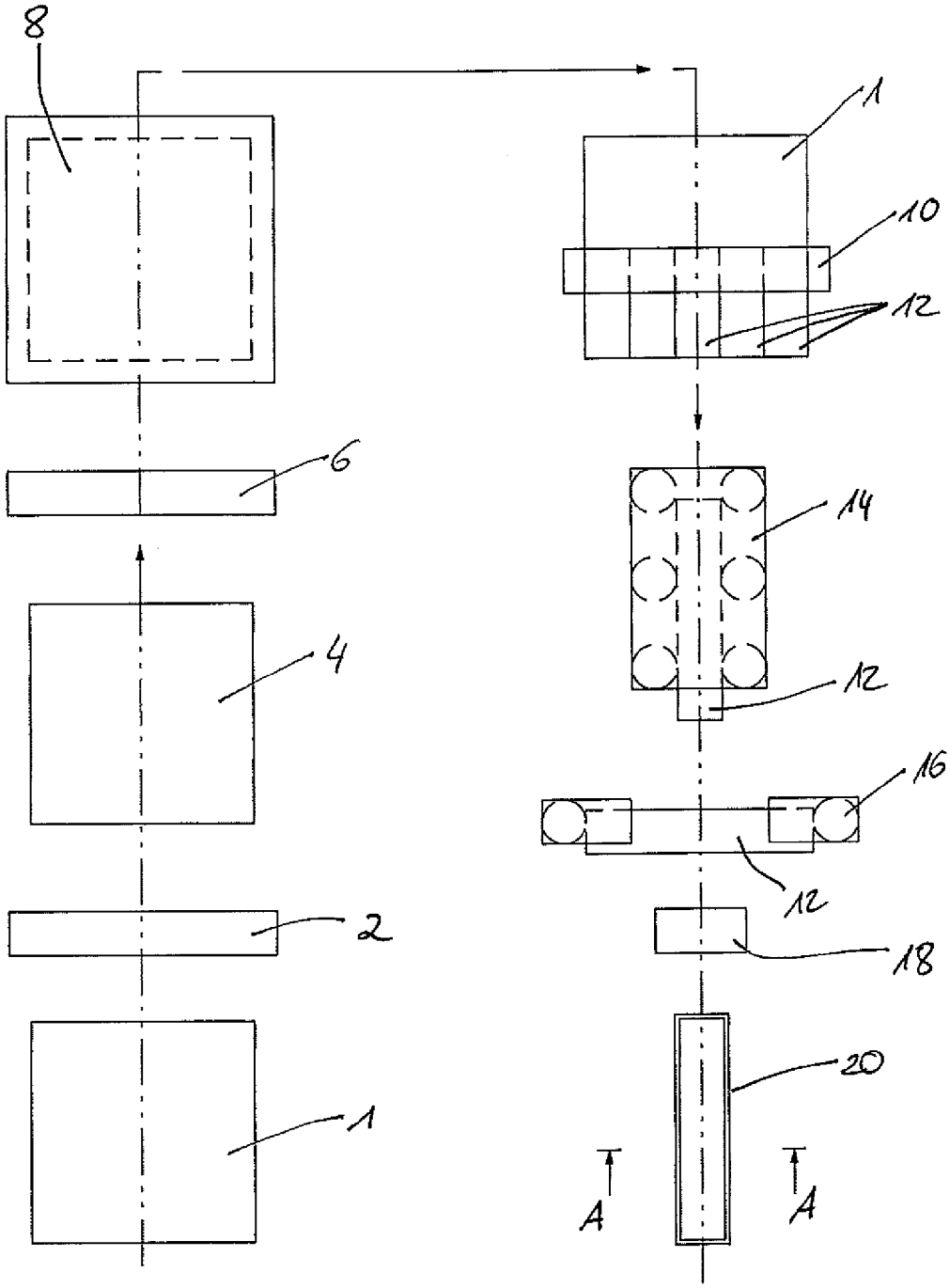
FIG. 1 shows a diagrammatic illustration of an exemplary embodiment of the method for the production of grounded panels.

FIG. 1 shows the diagrammatic illustration of a method for the production of a grounded panel as a semi-finished product, such as can be carried out at the laminate manufacturer's. The processing direction is identified by arrows. The production method commences at the bottom left in FIG. 1.

The method commences with a large-format wood material board 1. The wood material board 1 is first fed to a pre-treatment device 2 in which the large-format wood material board 1 is prepared for carrying out the method. Inside this pre-treatment device 2, for example, a topside of the wood material board 1 can be ground, or other smoothing of the surface can take place. The wood material board 1 is prepared such that a material layer can be applied to the topside. For this purpose, the wood material board 1 is, for example, additionally cleaned and/or heated in the pre-treatment device 2. Moreover, quality assurance can take place in order to ensure that the surface of the wood material board 1 is suitable for carrying out the method.

After the wood material board 1 has been prepared in the pre-treatment device 2, it is fed to a grounding device 4. In the grounding device 4, a grounding in the form of a synthetic resin layer is applied to the topside of the wood material board 1. This may take place, for example, by the application of a liquid synthetic resin layer or in the form of a resin-impregnated paper. Alternatively, for example, a film, which is coated, in particular, with a synthetic resin, may also be glued to the topside of the wood material board 1. An adhesive containing synthetic resin may also be used for this purpose.

After the wood material board 1 has passed through the grounding device 4, it is fed to a drying device 6 in the exemplary embodiment shown in FIG. 1. Here, where appropriate, the grounding applied to the topside of the wood material board 1 in the grounding device 4 and taking the form of a synthetic resin layer is dried.

The coated wood material board 1 subsequently passes, in the method shown in FIG. 1, through a short-stroke press 8 in which the wood material board 1 is pressed under the influence of pressure and temperature together with the grounding applied in the grounding device 4 in form of a synthetic resin layer. Other forms of a press, for example a belt press, may, of course, also be envisaged. Particularly when the grounding in the form of a synthetic resin layer is applied, already finish-cured, for example by means of a film, in the grounding device 4, if appropriate pressing only under the influence of pressure, without an increased temperature, is also sufficient.

The grounded wood material boards 1 pressed in the short-stroke press 8 subsequently pass through a cutting-to-size device 10 in which the large-format wood material board 1 is divided into smaller panels 12. Profiles are subsequently incorporated at the side edges of the panels 12 and make it possible to connect two identical panels 12 to one another. In this case, first, longitudinal profiles are milled out of the side faces of the panels 12 in a first milling device 14. It is consequently possible to connect two identical panels 12 to one another along their longer side faces.

The panels 12 subsequently pass through a second milling device 16 in which the short side faces are also provided with a profile, in this case a transverse profile. Identical panels 12 can therefore also be connected to one another along their short side edges.

The grounded panels provided with connection means subsequently pass through quality assurance 18 before they are packaged, in a transport-safe manner, in a packaging station 20.

During the pressing of the wood material board, coated with the grounding, in a short-stroke press 8 or in another press apparatus, in particular, a structure may be embossed into the grounding. Additionally or alternatively to this, a relief may also be provided in the large-format wood material board 1. So that a relief can be embossed into the wood material board 1, in particular, the wood material board 1 may be sprayed with water before the grounding is applied in the grounding device 4. An exemplary method was described in DE 10 2008 008 240.

Figure 2:
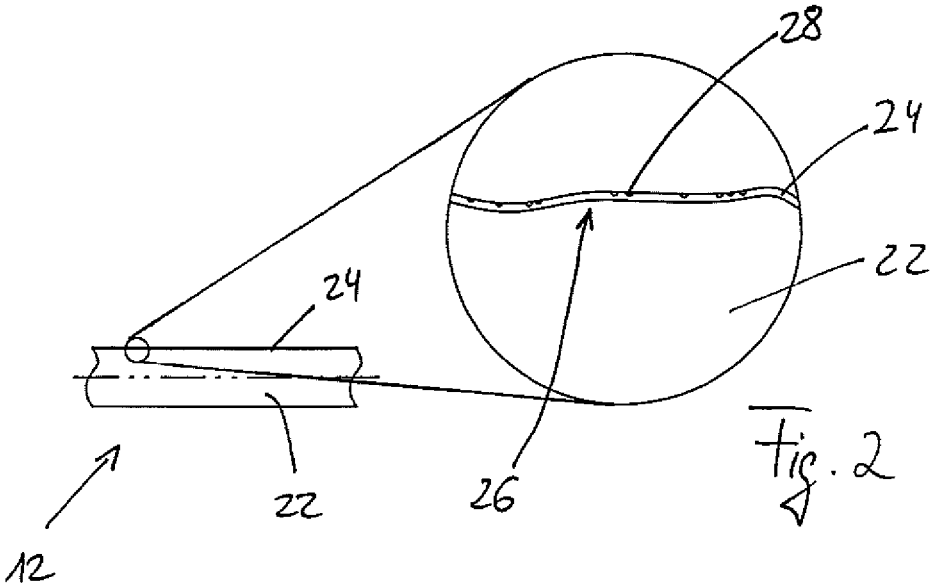
FIG. 2 shows a cross section through a panel produced by the method according to FIG. 1, with an enlarged detail from it.

FIG. 2 shows a section along the line A-A from FIG. 1 through a pre-grounded panel 12, and also in enlarged detail from this. The panel 12 comprises a core 22 onto which a grounding 24 has been applied. The topside of the core 22 shows a relief 26 in the form of an uneven surface of the core 22. A structure 28, which has markedly finer elements than the relief 26 embossed into the core 22, is embossed into the grounding 24.

Figure 3:
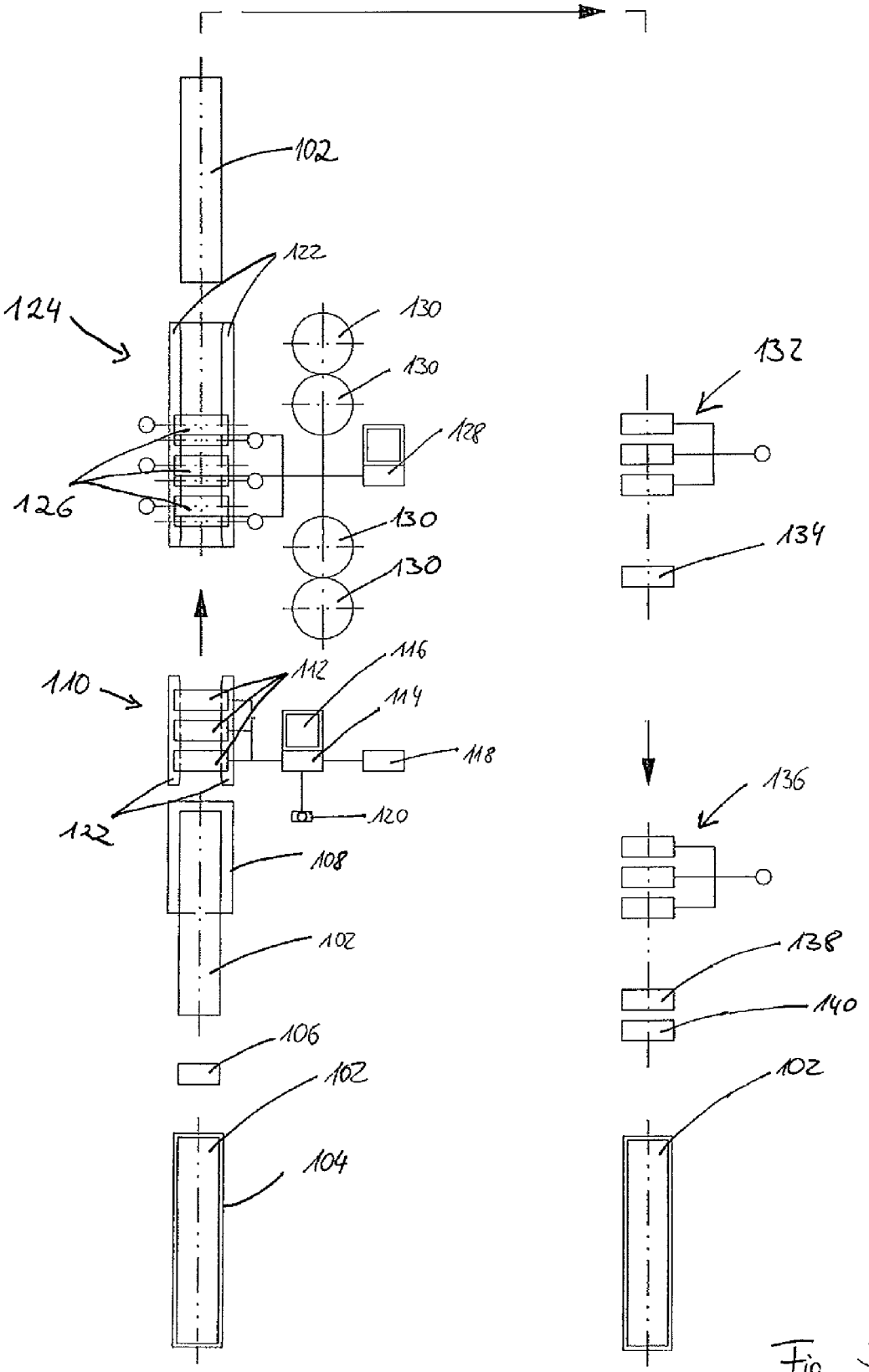
FIG. 3 shows a diagrammatic illustration of an exemplary embodiment of the method for the refinement of a panel, such as is carried out during further processing.

FIG. 3 shows the diagrammatic illustration of a method for the refinement of a panel, such as may be carried out during further processing, for example by a franchisee associated with the laminate manufacturer, in a home-improvement market or the like. The processing direction is identified by arrows. The processing method commences at the bottom left in FIG. 3.

The finish-grounded panels 102, coming from the laminate manufacturer in transport-safe packaging 104, are delivered for further processing. In a first method step, the panels 102 are removed from this transport-safe packaging 104. In the exemplary embodiment of the method, as shown in FIG. 3, the panels 102 are subsequently fed to a cleaning apparatus 106 in which the surface of the panels 102 is cleaned of dirt residues and dust which may possibly be adhering and is thus prepared for the application of the decorative layer. It is also conceivable, however, that the panels 102 have been cleaned suitably for later printing at the laminate manufacturer's. These can then have been introduced, cleaned, into the transport-safe packaging 104. By virtue of transport pack 104 being sealed, air-tight, in a film, for example, the situation can be ruled out where the panels 102 subsequently have to be cleaned again before they are printed.

After the panels 102 have, where appropriate, passed through the cleaning apparatus 106, they are aligned in an acceleration section 108 and spaced apart at the desired distance from one another. The panels 102 are subsequently fed to a printing unit 110. Here, the surface of the panel 102 is printed with the decorative layer to be applied. For this purpose, in the exemplary embodiment shown in FIG. 3, the printing unit 110 has three printing heads 112. Depending on the desired decoration, the printing unit 110 may also have more or fewer printing heads 112. Connected to the printing unit 110 is an electronic data processing device 114. This has an input device, not shown in FIG. 3, via which the user of an apparatus for carrying out the method can select the desired decoration.

For this purpose, the electronic data processing device 114 has an indicator device 116, via which the available decorations filed, for example, on an electronic storage medium are indicated to the user. The user can select from this selection the decoration which he would like to have printed onto his panels.

In the exemplary embodiment shown in FIG. 3, the electronic data processing device 114 additionally has a scanner 118. If, then, a user of the apparatus for the refinement of the panel 102 brings with him an individual decoration, for example in the form of a paper print-out, the pattern can be read via the scanner 118 into the electronic data processing device 114 and can be applied to the topside of the panel via the printing heads 112 of the printing unit 110. The user is therefore no longer restricted to the pattern selection filed in the electronic data processing device 114.

Moreover, in the exemplary embodiment shown in FIG. 3, the electronic data processing device 114 has a camera 120. Via this camera 120, it is possible, for example, to photograph decorations of surfaces which, for example, the customer has brought along, but which cannot be scanned, and thereby to read these decorations into the electronic data processing device. Even decorations of this type can be applied to the topside of the panel 102 via the printing heads 112 of the printing unit 110. For example, a CD-ROM drive may also be provided, via which the customer can cause a decoration stored in a defined format on a CD-ROM to be read into the data processing device 114.

So that the panels 102 remain exactly in alignment when the decoration is being applied by the printing heads 112, the said panels are guided in the printing unit 110 by guide elements 122.

In order to ensure as optimal a result as possible, the decoration proposals filed in the data store of the electronic data processing device 114 are optimized to the possible formats of the panels 102 to be printed. Individual decorations of a user of the apparatus described, which have been read into the electronic data processing device 114, for example, via the scanner 118, the drive or the camera 120, can be adapted to the panel formats. The decoration selection filed in the data store of the electronic data processing device 114 can in this case, in particular, be updated online.

After the topside of the panels 102 has been printed with a decoration, the panels 102 leave the printing unit 110 and are fed to a coating apparatus 124. In the exemplary embodiment illustrated in FIG. 3, this comprises three applicator devices 126, via which a wear layer can in each case be applied to the topside of the panel. The applicator devices 126 are controlled by a second electronic data processing device 128. This has a merge program by which the composition of the individual wear layers is controlled. The second electronic data processing device 128 can in this case activate various reservoirs 130 and mix their contents to form the wear layer desired in each case. One of these reservoirs 130 contains the basic substance of each individual wear layer which, for example, may be a synthetic resin or else a lacquer. The further reservoirs 130 contain, for example, hardeners, corundum for increasing the abrasion resistance of the finish-coated panel and further additives which are selected according to the intended use of the then finished panel.

As in the printing unit 110, different panel formats can also be processed in the coating apparatus 124. The panels 102 to be coated are also guided via guide elements 122 inside the coating apparatus 124. A possible layer build-up consists of a plurality of layers of radiation-hardenable lacquer. In this case, for example, two layers of an anti-abrasive UV basic lacquer are applied by means of a roller system in an application quantity of, for example, 35 g/m$^2$ to the topside, to be coated, of the panel 102. Each applicator device 126 is in this case designed in the form of a roller system. After the two layers of the anti-abrasive basic lacquer are applied, two further layers of a UV yellow earth size may likewise be applied in each case by means of an applicator device 126 designed as a roller system. The application quantity here amounts, for example, to 15 g/m$^2$ per yellow earth size layer. Finally, via a further applicator device 126, a layer of a UV covering lacquer is applied in an application quantity of, for example, 35 g/m$^2$. If appropriate, before each lacquer layer is applied, the lacquer layer previously applied is cured by means of UV or electron beams. In the exemplary embodiment shown in FIG. 3, the various wear layers, which, in particular, may also consist of a synthetic resin, are applied directly in succession, without the wear layer previously applied by an applicator device 126 being dried.

An applicator device 126 in the form of rollers may in this case be operated both in synchronism and in opposition. So that as many panels 102 as possible can be coated in a predetermined time, high speeds of advance of applicator devices 126 of this type are preferred. In particular, speeds of advance of between 10 m/min and 30 m/min are suitable here.

If lacquer layers are applied as wear layers in the coating apparatus 124 by the applicator devices 126, these applicator devices 126 may also be designed in the form of a splash or spray-lacquering device, a digital printing head, a casting head or a vacuum apparatus. Each layer applied may contain abrasion-resistant particles, for example corundum, or other additives. These depend on the subsequent use of the then finished panel.

After the panels 102 have left the coating apparatus 124, they are led to a first curing device 132. In the exemplary embodiment shown in FIG. 3, the wear layers which are applied in the coating apparatus 124 and may be present, for example, in the form of a lacquer are simply gelled merely by high-energy beams, for example electron or UV beams. Subsequently, in an embossing device 134, a structure is embossed into the topside of the coated panel, that is to say the wear layers. This structure, in particular, matches with the selected decoration of the decorative layer applied in the printing unit 110.

The embossing of the structure may in this case take place, for example, by means of a structured roller, a structured belt or a structure donor paper or structure donor film.

Alternatively, an overlay paper sheet may also be laid in place and subsequently pressed in a short-stroke press under the action of pressure and heat. In this case, in particular, structures are provided in the press plates and, during pressing, are embossed into the topside of the panel 102.

Particularly when lacquers are used as wear layers, a structure-forming quantity of lacquer may also be applied by means of a, for example, digitally activated printing head. Alternatively, a means which disturbs the flow of the lacquer may also be envisaged. This means, too, may be applied, using a digitally activated printing head. By a printing head of this type being used, it is possible to apply the means or the lacquer only at specific locations on the surface of the panel 102 and thus generate structure-forming depressions and elevations. If the structure embossed into the topside is to match with the decoration of the decorative layer, the panel 102 must be aligned before it passes through the embossing device 134. In the exemplary embodiment illustrated in FIG. 3, after passing through the embossing device 134, the panel 102 passes through a second curing device 136. Here, the, if appropriate, gelled wear layers are cured completely, so that a surface suitable for the in each case chosen use of the panel 102 is obtained.

Subsequently, the panels 102 pass through quality assurance 138, if appropriate labelling 140 or the like, if appropriate additionally also a cleaning device, and are finally packaged and can be taken away by the customer.

Especially advantageously, the electronic data processing device 114 is coupled to the second electronic data processing device 128. Then, during further processing, a customer is given various selection possibilities, for example, by means of a program. He can in this case, for example, choose whether the panel 102 is to be used privately or commercially, in a dry or a damp area, with references to various commercial classes of use being given. Moreover, the customer can decide whether the panel 102 to be coated will later be a floor, wall or ceiling panel. This information is important for the wear layers to be applied in the coating apparatus 124. In an apparatus for the refinement of a panel, the wear layers necessary for achieving a specific wear class, for example AC3 according to DIN EN 13329, are then applied automatically together with the required aggregates and additives. Lacquering and hardening in this case take place automatically.

Moreover, the customer can select the format of the panel and the thickness of the carrier board and also the desired decoration and, where appropriate, a structure to be embossed. By means of these customer stipulations, both the printing unit 110 and the coating apparatus 124 can be set to the thickness and format of the panels 102 to be coated.

Further selection possibilities for the customer are, for example, the selection of specific packaging. Thus, the panels may be introduced simply into a cardboard carton or may be packaged so as also to be protected against splashes of water by means of a film, for example a shrink film. Moreover, the customer can, for example, decide whether he would like to take the finished panels away immediately or fetch them himself at a later time or whether they are to be delivered by an outside firm.

An installation option by a specialized firm may also be envisaged. Moreover, the customer can, where appropriate, select warrantee and guarantee options for an extra price and, if appropriate, decide whether he buys or rents the panels.

The lacquering and curing of the lacquer layers may take place automatically inside a plant for the refinement of a panel according to the method described. Since the lacquers or resin layers used, which are applied as wear layers, can be optimized for this application, particularly in terms of their viscosity, a smooth application, without extra or fewer applications of lacquer at the start and end of the panels 102 to be coated, can be ensured. In order to protect the connection and locking elements already integrally formed on the panels 102, masks may be used which prevent the soiling or contamination of these connection and locking elements. Particularly during the curing of applied lacquer layers, the adhesion of the individual layers to one another and final curing can be implemented and ensured by setting the beam intensity. For multiple applications, the corresponding plant part, that is to say the coating apparatus 124 and the first curing device 132 and second curing device 136, can be passed through several times.

For the optimum utilization of a plant of this type, a plurality of applications may be produced directly in succession. After an application is concluded, fully automatic cleaning, in particular, of the applicator devices 126 may take place, so that a clean plant can be provided for the next application.

The method described has a series of advantages. After the finishing of the surface, the customer can take the finished product away immediately in the desired quantity and quality. Consequently, in particular, the problem of small quantities is solved for the laminate panel manufacturer, since he simply has to produce one type of panel, to be precise pre-grounded and structured panels, where appropriate, in different dimensions. Since the connection and locking means are milled onto pre-grounded panels or incorporated in another form in this method, the milling waste which occurs is reduced, in particular, in that no decorative paper or overlay paper is applied to the pre-grounded panels. The production costs are thereby markedly reduced. Moreover, by virtue of the method described, transport damage or transfer faults in orders are markedly reduced, since the customer can stand directly in front of the apparatus and input his wishes. It is no longer necessary for an order to be transferred to a laminate manufacturer.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The invention claimed is:

1. A method for the refinement of a panel offsite from an unfinished panel manufacturing facility and installation site, having a core made from wood material and a grounding, arranged on a top side of the core, in a form of at least one synthetic resin layer pressed together with the core, the panel, being located in a transport-safe packaging which is sealed, air-tight, in a film, with the following steps:

a) unpacking of one or more panels from the transport-safe packaging, b) selection of a special decoration from a multiplicity of stored decorations or of an individually available decoration, c) selection of a defined number of panels, which are to be printed with the decoration, d) application of a decorative layer having the selected decoration to each individual panel, and e) application of at least one wear layer to the decorative layer.

2. The method according to claim 1, wherein the multiplicity of stored decorations are stored in a form of electronic data in a data store.

3. The method according to claim 1, wherein the grounding is present in the form of a synthetic resin layer applied as a liquid or in the form of a resin-impregnated paper or in the form of a glued-on film which is coated with synthetic resin.

4. The method according to claim 3, further comprising adhesive used for the glued-on film which is an adhesive containing synthetic resin.

5. The method according to claim 3, wherein the grounding is applied before the transport-safe packaging of the panels.

6. The method according to claim 1, wherein the panel has a coating on its underside.

7. The method according to claim 6, wherein the coating of the underside of the panel is applied before the transport-safe packaging of the panels.

8. The method according to claim 1, wherein a primer is applied to the grounding before the transport-safe packaging of the panels.

9. The method according to claim 1, wherein side faces of the panels are provided with connecting and locking means before the transport-safe packaging of the panels.

10. The method according to claim 1, wherein the decorative layer is printed onto the grounding or a primer.

11. The method according to claim 1, wherein a decorative paper is printed with a decoration and is laid as a decorative layer onto the grounding or a primer.

12. The method according to claim 1, wherein the at least one wear layer consists of a synthetic resin and, after being applied, is cured by pressing under influence of pressure and temperature.

13. The method according to claim 12, wherein a structure is introduced into the at least one wear layer during the pressing.

14. The method according to claim 1, wherein the at least one wear layer consists of a lacquer and, after being applied, is cured by means of electron or UV beams.

15. The method according to claim 14, wherein a structure is introduced into the at least one wear layer by a structure-forming lacquer.

16. The method according to claim 14, wherein means disturbing the flow of the lacquer are printed on, at least one of structure-forming depressions and elevations thereby being generated.

17. The method according to claim 1, wherein the application of the decorative layer and of the at least one wear layer takes place by means of the following steps:

provision of the at least one wear layer on a carrier medium, printing of the decorative layer onto the at least one wear layer, laying of the carrier medium, at least one wear layer and decorative layer onto the grounding or a primer, so that the decorative layer is arranged on the grounding or the primer, and removal of the carrier medium.

18. The method according to claim 17, wherein a structure is embossed into at least an uppermost wear layer.

19. The method according to claim 18, wherein the structure matches the decoration of the decorative layer.

20. The method according to claim 1, wherein the panel is cleaned before the decorative layer is applied.

21. The method according to claim 1, wherein the application of the decorative layer is provided at a franchise operation associated with a laminate manufacturer, home-improvement market, an interior decorator, a dealer or a floor layer.

22. The method according to claim 21, wherein the application of the decorative layer is printed directly onto a grounding or a primer by a digital printer.

23. The method according to claim 21, wherein the at least one wear layer is a plurality of wear layers admixed with additives applied at the franchise operation associated with the laminate manufacturer, the home-improvement market, the interior decorator, the dealer or the floor layer.

24. The method according to claim 23, wherein the at least one wear layer is cured under influence of pressure and temperature or using high-energy radiation.

25. The method according to claim 21, wherein a customer selects the special decoration and an amount of panels to be printed with the selected decoration at the franchise operation associated with the laminate manufacturer, the home-improvement market, the interior decorator, the dealer or the floor layer.

26. The method according to claim 21, further comprising:

aligning a selected amount of panels in an acceleration section and spaced apart at a desired distance from one another;

feeding the selected amount of panels individually into a printing unit; and selecting the special decoration from an electronic data storage medium for printing onto the selected amount of panels.

27. The method according to claim 21, further comprising applying lacquer only at specific locations on a surface of the panel to generate structure-forming depressions and elevations.

28. The method according to claim 21, further comprising selecting, by a customer at the franchise operation associated with the laminate manufacturer, the home-improvement market, the interior decorator, the dealer or the floor layer, whether the panel is to (i) be used privately or commercially, (ii) be used in a dry or a damp area and (iii) be coated for use as a floor, wall or ceiling panel, in order to determine how many wear layers are to be applied to the panel.

29. The method according to claim 1, wherein the individually available decoration is provided by a customer stored in electronic form in a predetermined data format.

30. The method according to claim 1, further comprising scanning the individually available decoration into electronic format for subsequent printing onto each individual panel.

31. The method according to claim 1, further comprising taking a photograph of the individually available decoration and reading the photograph into electronic data for subsequent printing onto each individual panel.

32. The method according to claim 1, wherein the unfinished panel manufacturing facility, the installation site and the where the application of the decorative layer is provided are three different locations.

33. The method according to claim 32, wherein the location where the application of the decorative layer is applied receives from the unfinished panel manufacturing facility a semi-finished panel sealed in the transport-safe packaging.

34. A method for the refinement of a panel at a first location which is different than an installation site and a location which manufactures a semi-finished wood panel with a core and at least one synthetic resin layer pressed together with the core, and which places the semi-finished wood panel in a transport-safe packaging which is sealed, air-tight, in a film, with the following steps being performed at the first location:

a) unpacking of one or more panels from the transport-safe packaging, b) selection of a special decoration from a multiplicity of stored decorations or of an individually available decoration, c) selection of a defined number of panels, which are to be printed with the decoration, d) application of a decorative layer having the selected decoration to each individual panel, and e) application of at least one wear layer to the decorative layer.

35. The method according to claim 34, wherein the location that manufactures the semi-finished wood panel is a production plant.

36. The method according to claim 35, wherein the production plant, the installation site and the where the application of the decorative layer is provided are three different locations.

37. The method according to claim 36, wherein the first location is a franchise operation associated with a laminate manufacturer, home-improvement market, an interior decorator, a dealer or a floor layer.

* * * * *